US011253123B2

(12) United States Patent
Jung et al.

(10) Patent No.: US 11,253,123 B2
(45) Date of Patent: Feb. 22, 2022

(54) VACUUM CLEANER

(71) Applicant: Samsung Electronics Co., Ltd, Suwon-si (KR)

(72) Inventors: Byeongheon Jung, Suwon-si (KR); Jonggook Lim, Suwon-si (KR); Seokbong Baek, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 140 days.

(21) Appl. No.: 16/557,591

(22) Filed: Aug. 30, 2019

(65) Prior Publication Data

US 2020/0069131 A1 Mar. 5, 2020

(30) Foreign Application Priority Data

Aug. 30, 2018 (KR) ..... 10-2018-0102997

(51) Int. Cl.
*A47L 9/24* (2006.01)
*A47L 9/28* (2006.01)
*A47L 9/14* (2006.01)

(52) U.S. Cl.
CPC ..... *A47L 9/242* (2013.01); *A47L 9/1409* (2013.01); *A47L 9/248* (2013.01); *A47L 9/2868* (2013.01)

(58) Field of Classification Search
CPC ..... A47L 9/242; A47L 9/248; A47L 9/2868; A47L 9/246; A47L 9/28; H01R 13/58
USPC ..... 15/350
See application file for complete search history.

(56) References Cited

U.S. PATENT DOCUMENTS 5,109,568 A * 5/1992 Rohn ..... A47L 9/242 15/377
6,354,635 B1 * 3/2002 Dyson ..... A47L 9/242 285/308
6,486,396 B2 * 11/2002 Stein ..... A47L 9/244 15/377

(Continued)

FOREIGN PATENT DOCUMENTS

GB 2525225 B 9/2016
JP H0722761 A * 1/1995

(Continued)

OTHER PUBLICATIONS

Korean Intellectual Property Office, Office Action, Application No. KR 10-2018-0102997, dated Oct. 30, 2019, 12 pages.

(Continued)

*Primary Examiner* — Joseph J Hail
*Assistant Examiner* — Jonathan R Zaworski

(57) ABSTRACT

A vacuum cleaner comprises a cleaner main body configured to generate suction power; a suction unit configured to suck up dust and foreign substances by the suction power; a connection pipe configured to transfer the sucked dust and foreign substances; a connection unit comprising a connection pipe accommodator configured to accommodate an end portion of the connection pipe, a separation controller configured to separate the accommodated end portion of the connection pipe from the connection pipe accommodator, and a space configured to place the separation controller therein; and a power cable configured to supply electric power from the cleaner main body to the suction unit, and disposed to pass through the space in which the separation controller of the connection unit is provided.

20 Claims, 11 Drawing Sheets

(56) References Cited

U.S. PATENT DOCUMENTS

| | | | | |
|---|---|---|---|---|
| 6,766,558 | B1 * | 7/2004 | Matsumoto | A47L 9/2821 15/353 |
| 7,727,003 | B2 * | 6/2010 | Ceroll | B27B 5/29 439/447 |
| 8,769,764 | B2 * | 7/2014 | Crouch | A47L 9/0018 15/328 |
| 9,106,008 | B2 * | 8/2015 | Inagaki | H01R 13/5833 |
| 9,655,488 | B2 * | 5/2017 | Cordes | A47L 9/242 |
| 2004/0123415 | A1 | 7/2004 | Mimura et al. | |
| 2006/0174440 | A1 | 8/2006 | Genoa et al. | |
| 2019/0208974 | A1 * | 7/2019 | Oka | A47L 9/246 |

FOREIGN PATENT DOCUMENTS

| | | | |
|---|---|---|---|
| JP | 10-165339 | A | 6/1998 |
| JP | 2000271050 | A | 10/2000 |
| JP | 3299420 | B2 | 7/2002 |
| JP | 3540052 | B2 | 7/2004 |
| JP | 3655131 | B2 | 6/2005 |
| JP | 2016127895 | A | 7/2016 |
| JP | 2016195632 | A | 11/2016 |
| JP | 2017-192436 | A | 10/2017 |
| KR | 20-1994-0014527 | U | 7/1994 |
| KR | 20-1996-0003986 | U | 2/1996 |
| KR | 10-0963751 | B1 | 6/2010 |
| KR | 10-2012-0124565 | A | 11/2012 |
| WO | 2018/087937 | A1 | 5/2018 |

OTHER PUBLICATIONS

Korean Intellectual Property Office, "Notice of Allowance," Application No. KR 10-2018-0102997, dated Jan. 6, 2020, 3 pages.
Partial European Search Report dated Apr. 2, 2020 in connection with European Patent Application No. 19 19 1959, 9 pages.
European Search Report dated Dec. 9, 2020 in connection with European Application No. 20189668.5, 7 pages.

* cited by examiner

VACUUM CLEANER

CROSS-REFERENCE TO RELATED THE APPLICATION

This application is based on and claims priority under 35 U.S.C. § 119 to Korean Patent Application No. 10-2018-0102997 filed on Aug. 30, 2018 in the Korean Intellectual Property Office, the disclosure of which is incorporated by reference herein in its entirety.

BACKGROUND

1. Field

The disclosure relates to a vacuum cleaner having a connection pipe formed with a passage to suck up dust or foreign substances.

2. Description of the Related Art

A stick-type vacuum cleaner includes a cleaner main body to generate suction power; a suction unit to suck up dust or foreign substances from a carpet or the like surface to be cleaned; and a stick including a connection pipe having a passage through which the sucked dust or foreign substance is transferred from the suction unit. The stick may include an upper end to which the cleaner main body is connected, and a lower end to which the suction unit is connected. The cleaner main body includes a dust container which accommodates the dust or the foreign substances sucked through the stick. The suction unit includes a rotatable drum brush, and a motor for rotating the drum brush. Therefore, the stick is provided with a power cable, which supplies power from the cleaner main body to the motor of the suction unit, along a lengthwise direction.

Meanwhile, the stick includes a connection pipe, and a separation button for separating or coupling the connection pipe in the front thereof, and includes the power cable on the back of a main-body mounting portion opposite to the separation button. In this case, the dust container is disposed in the front of the stick along the lengthwise direction from the cleaner main body. Therefore, the design of the dust container is restricted by the separation button protruding from the front. In result, it is difficult to design a conventional vacuum cleaner to be long so as to increase the capacity of the dust container. Further, a conventional vacuum cleaner is not only aesthetically bad but also hardly arranges other components such as the dust container thereon because many separation buttons are arranged in the front of the stick.

SUMMARY

An aspect of the disclosure is to provide a vacuum cleaner comprising: a cleaner main body configured to generate suction power; a suction unit configured to suck up dust and foreign substances by the suction power; a connection pipe configured to transfer the sucked dust and foreign substances; a connection unit comprising a connection pipe accommodator configured to accommodate an end portion of the connection pipe, a separation controller configured to separate the accommodated end portion of the connection pipe from the connection pipe accommodator, and a space configured to place the separation controller therein; and a power cable configured to supply electric power from the cleaner main body to the suction unit, and disposed to pass through the space in which the separation controller of the connection unit is provided.

The space is formed by an inner wall forming a boundary against the connection pipe accommodator, and an outer wall of the connection pipe accommodator spaced apart from the inner wall in a radial direction.

The separation controller comprises: a lever comprising a holding end portion configured to protrude toward or separate from an inside of the connection pipe accommodator while passing through the inner wall; an elastic body configured to produce elastic force to push the holding end portion toward the inside of the connection pipe accommodator; and a button portion configured to move the lever in a direction opposite to the elastic force to separate the holding end portion from the inside of the connection pipe accommodator.

The lever comprises a first lever and a second lever spaced apart in a circumferential direction of the connection pipe accommodator.

The lever comprises a lever connector configured to connect the first lever and the second lever as a single body, and the button portion urges the lever connector in a direction opposite to the elastic force.

The power cable passes between the first lever and the second lever.

The separation controller comprises a lever comprising a holding end portion configured to protrude toward or separate from an inside of the connection pipe accommodator, and the end portion of the connection pipe accommodated in the connection pipe accommodator comprises a holding-end-portion accommodating groove in which the holding end portion is inserted.

The power cable comprises a plurality of wires, and the connection unit comprises a connector comprising a plurality of connection terminals electrically connected to the plurality of wires.

The plurality of connection terminals are electrically connected to the plurality of wires within a space where the separation controller is placed.

The connection pipe comprises a first end portion connected to the cleaner main body, and a second end portion connected to the connection unit.

The connection pipe comprises a first end portion connected to the suction unit, and a second end portion connected to the connection unit.

The connection pipe comprises a first connection pipe comprising a first end portion connected to the cleaner main body, and a second connection pipe provided between the first connection pipe and the suction unit, and the connection unit comprises: a first connection unit configured to connect a second end portion of the first connection pipe and a first end portion of the second connection pipe; and a second connection unit configured to connect a second end portion of the second connection pipe and the suction unit.

The space in which the separation controller is placed comprises a cable holder configured to hold the power cable.

The cable holder comprises: a first column around which the wire is wound; at least one first cable-support wall standing as spaced apart from the first column and supporting the wire wound around the first column; a second column standing as spaced apart from the first column and making the wire coming around from the first column be wound therearound; and a second cable-support wall standing as spaced apart from the second column and supporting the wire coming around from the second column.

The connection unit has an oval shape, and the separation controller is provided at a first side in a major radial direction of the connection unit.

The space in which the separation controller is placed is partitioned by an outer wall of the connection unit in the major radial direction and an inner wall forming a part of the connection pipe accommodator.

The connection pipe accommodator is formed by an inner wall of the connection unit in a minor radial direction and an outer wall of the connection unit in the major radial direction.

Another aspect of the disclosure is to provide a vacuum cleaner having a stick-type vacuum cleaner comprising: a cleaner main body comprising a dust container configured to accommodate sucked dust or foreign substances; a suction unit configured to suck up dust and foreign substances by suction power; and a stick configured to transfer the dust or foreign substances sucked up through the suction unit to the dust container, wherein the stick comprises: a connection pipe comprising a passage configured to transfer the sucked dust or foreign substances; a connection unit comprising a connection pipe accommodator detachably accommodating an end portion of the connection pipe and a separation controller making the accommodated end portion of the connection pipe be separable from the connection pipe accommodator; and a power cable provided along a lengthwise direction of the stick and configured to supply electric power from the cleaner main body to the suction unit, the dust container is disposed on a front of the stick along a lengthwise direction and adjacent to the stick, and the separation controller and the power cable are disposed on a back of the stick.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Below, embodiments of a vacuum cleaner 1 according to the disclosure will be described in detail with reference to accompanying drawings. To help understanding of the following embodiments, a stick type vacuum cleaner will be described for illustrative purpose only. However, it will be appreciated that a handy type, handy-stick type, canister type, upright type and the like vacuum cleaners according to various alternative embodiments are also applied on the contrary to the embodiment set forth herein. In terms of describing the disclosure, the detailed description and concrete illustration for the related well-known functions or elements will be omitted when they cloud the gist of the disclosure.

Terms 'front' and 'back' used in describing an embodiment of the disclosure respectively indicate a front and a back of a progress line in which a drum brush of a suction unit rotates and travels.

Figure 1:
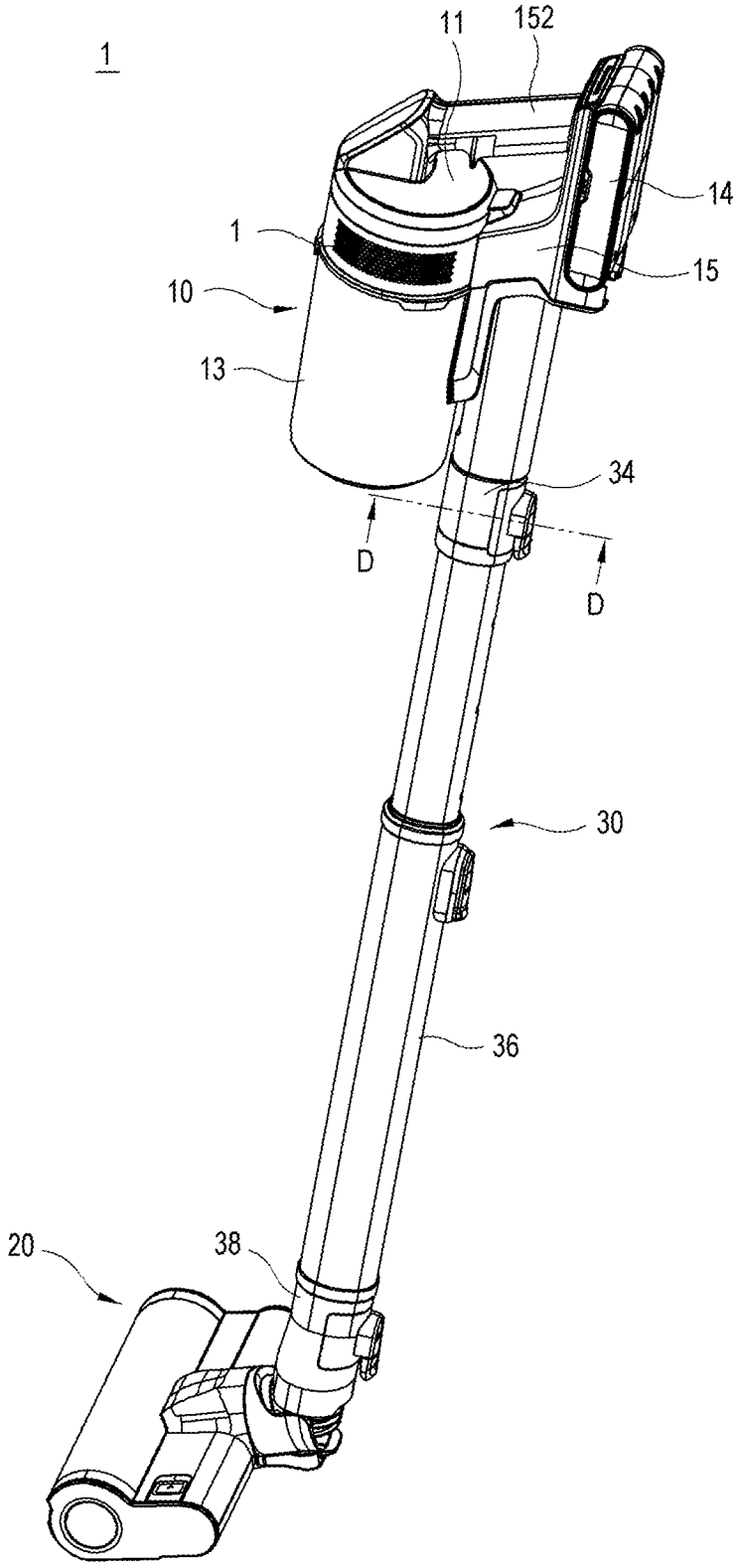
FIG. 1 is a perspective view of a vacuum cleaner according to an embodiment of the disclosure.

FIG. 1 is a perspective view of a vacuum cleaner 1 according to an embodiment of the disclosure. According to an embodiment of the disclosure, the vacuum cleaner 1 includes a cleaner main body 10 to generate suction power, a suction unit 20 to suck up dust or foreign substances from a surface to be cleaned, and a stick 30 having a passage through which the dust or the foreign substances move between the cleaner main body 10 and the suction unit 20.

Figure 2:
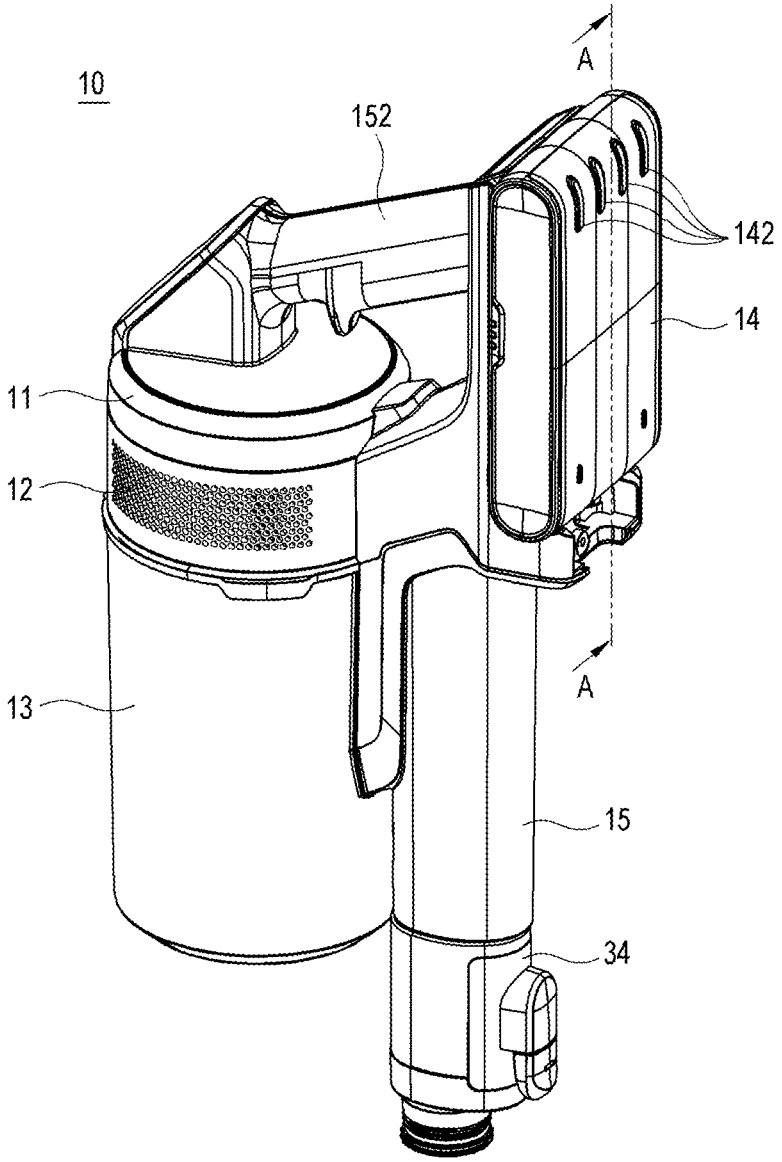
FIG. 2 is a perspective view of a cleaner main body in FIG. 1.
Figure 3:
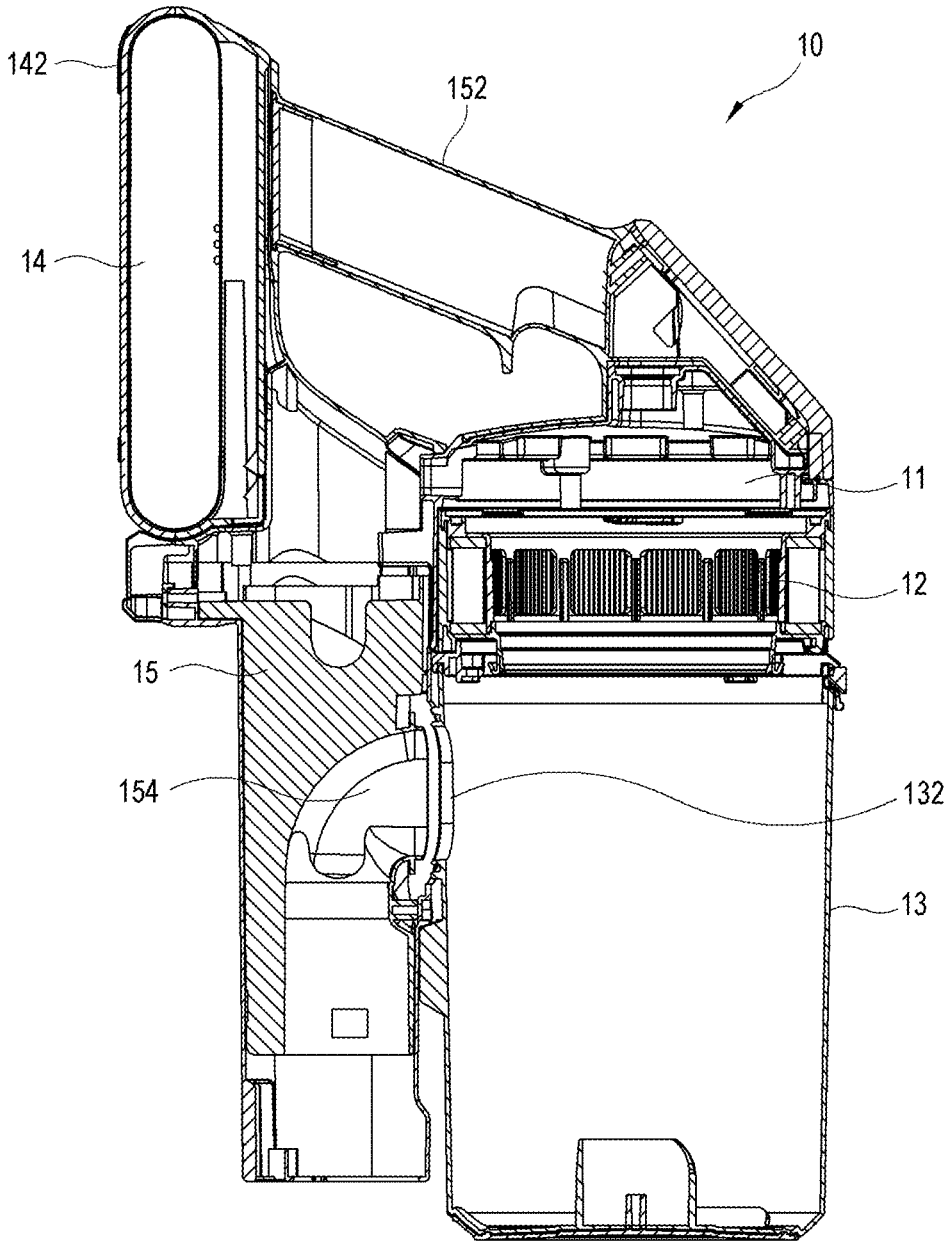
FIG. 3 is a cross-section view taken along line A-A in FIG. 1.

FIG. 2 is a perspective view of a cleaner main body 10 in FIG. 1, and FIG. 3 is a cross-section view taken along line A-A in FIG. 1. As shown therein, the cleaner main body 10 includes a suction motor 11 to generate the suction power, a dust-collection filter 12 to collect the sucked dust or foreign substances, a dust container 13 to be filled with the dust or the foreign substances collected by the dust-collection filter 12, a battery 14 to supply power to the suction motor 11, a mounting portion 15 to which components of the cleaner main body 10 are mounted, and a grip 152.

The suction motor 11 generates the suction power to suck up the dust or the foreign substances.

The dust-collection filter 12 is detachably coupled to the suction motor 11 so as to collect the dust or the foreign substances from air sucked up from the surface to be cleaned, by the suction power.

The dust container 13 is detachably coupled to the cleaner main body 10. The dust container 13 includes an inlet airtightly coupled to the dust-collection filter 12. Further, the dust container 13 is adjacent to the mounting portion 15 along the lengthwise direction of the stick 30. The dust container 13 includes a dust inlet 132 at a lateral side thereof into which the dust or the foreign substances are introduced.

The suction motor 11, the dust-collection filter 12 and the dust container 13 are assembled into a cylindrical assembly, and adjacent to and mounted to the mounting portion 15 along a lengthwise direction of a first connection pipe 32.

The battery 14 is detachably coupled to the mounting portion 15. The battery 14 may include a rechargeable secondary battery. The battery 14 supplies power to the suction motor 11 and the suction unit 20 (to be described later). The battery 14 includes a charging terminal 142. The mounting portion 15 is mounted with the suction motor 11, the dust-collection filter 12 and the dust container 13, the first connection pipe 32, and the battery 14 as they are assembled. The mounting portion 15 includes a grip 152 to be gripped by a user. The mounting portion 15 includes a dust through hole 154 connecting a certain end portion of the first connection pipe 32 and the dust inlet 132 of the dust container 13. The mounting portion 15 may further include a diving circuit (not shown) for cleaning operation, a power line (not shown) supplying power from the battery 14 to the suction motor 11 and the suction unit 20, etc.

Air sucked up from the surface to be cleaned is introduced into the dust container 13 via the first connection pipe 32 and the dust through hole 154, and discharged outward as the dust or the foreign substances are filtered out through the dust-collection filter 12.

Figure 4:
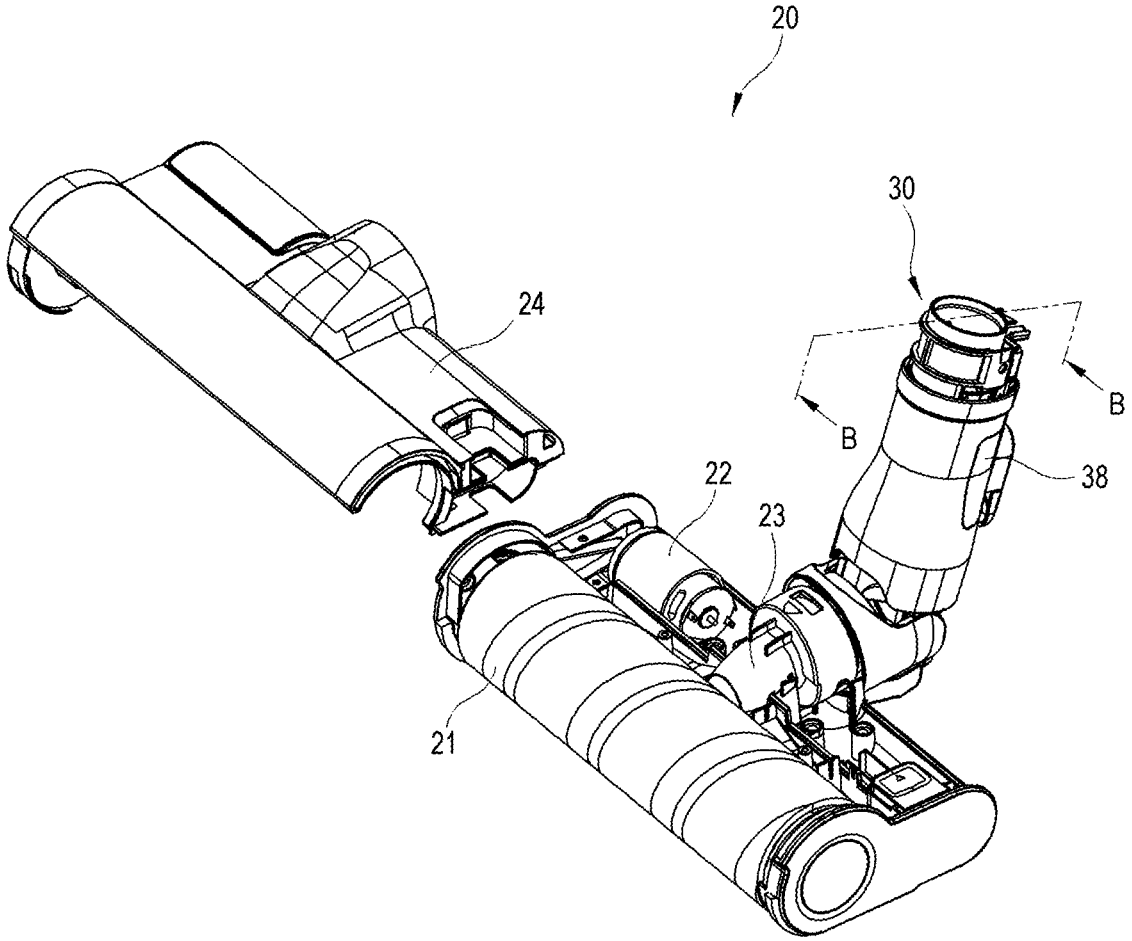
FIG. 4 is a perspective view of a suction unit in FIG. 1.
Figure 5:
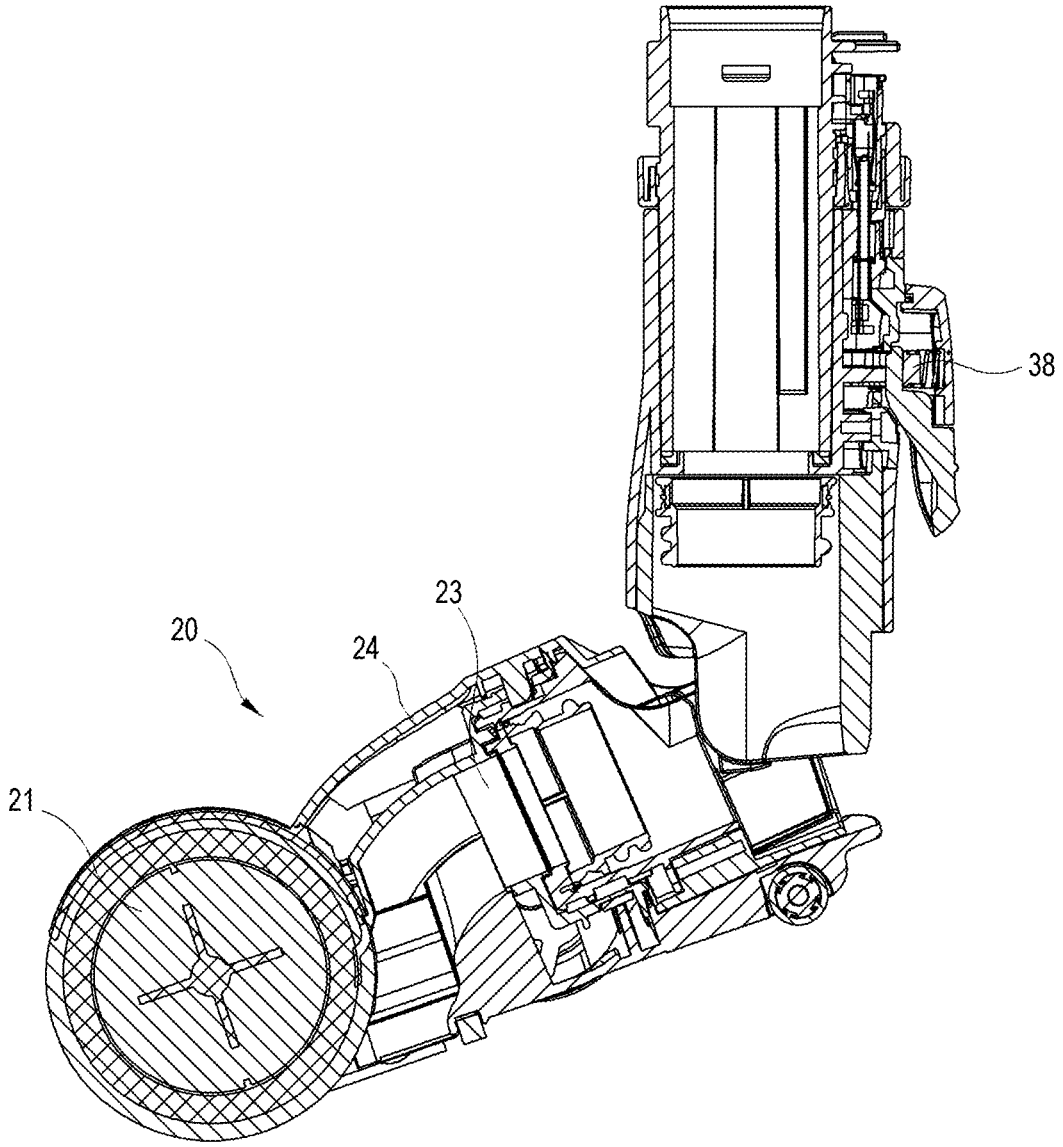
FIG. 5 is a cross-section view taken along line B-B in FIG. 4.

FIG. 4 is a perspective view of the suction unit 20 from which a cover 24 is separated, and FIG. 5 is a cross-section view taken along line B-B in FIG. 4.

The suction unit 20 includes a drum brush 21, a driving motor 22 driving the drum brush 21 to rotate, and a suction channel 23.

The drum brush 21 is provided in the form of a rotatable cylindrical roller having an outer circumference on which a cotton flannel or the like cleaning member is wound. The drum brush 21 clears dust away from the deep pile of the carpet and makes the dust fly upward from the carpet. The driving motor 22 generates driving power for rotating the drum brush 21. The driving motor 22 receives electric power from the battery (see '14' in FIG. 3) of the cleaner main body 10 ('10' in FIG. 3) through the stick (see '30' in FIG. 1).

The suction channel 23 sucks the dust or the foreign substances, which are flown upward by the drum brush 21, by the suction power of the cleaner main body 10. The dust or the foreign substances introduced into the suction channel 23 are transferred to a second connection unit 38.

Figure 6:
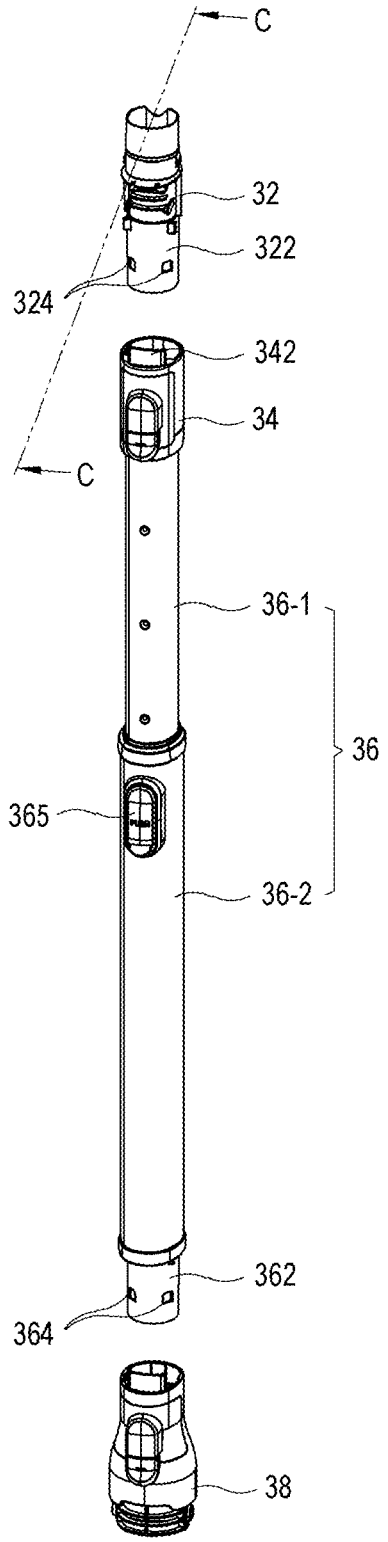
FIG. 6 is an exploded perspective view of a stick in FIG. 1.
Figure 7:
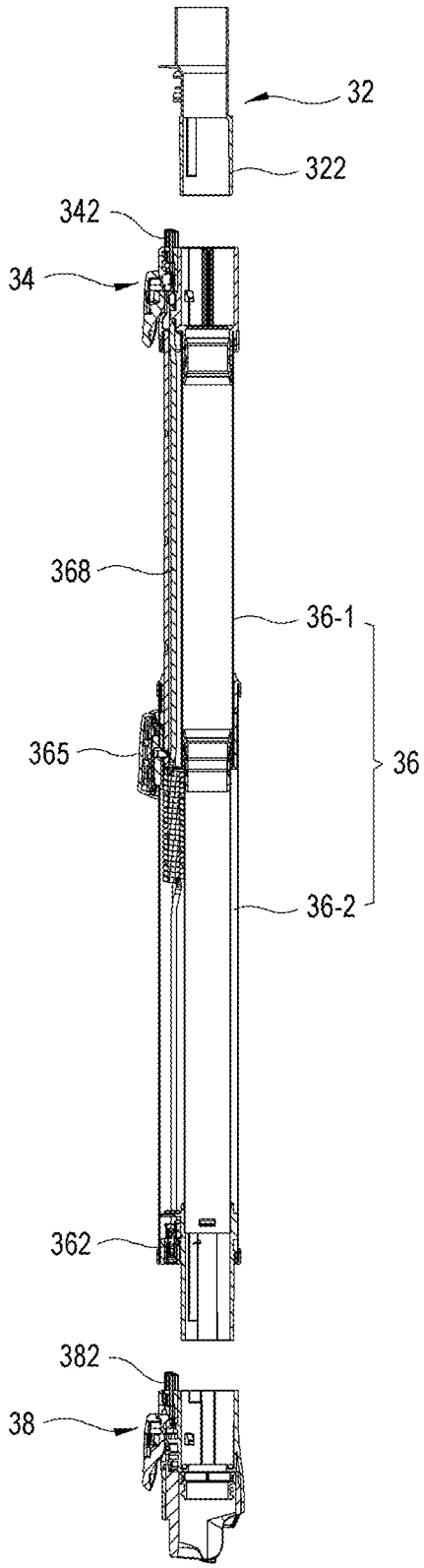
FIG. 7 is a cross-section view taken along line C-C in FIG. 6.

FIG. 6 is an exploded perspective view of a stick in FIG. 1, and FIG. 7 is a cross-section view taken along line C-C in FIG. 6. Referring to FIGS. 1, 6 and 7, the stick 30 is shaped like a hollow pipe, and forms a passage through which the sucked dust or foreign substances are transferred from the suction unit 20 to the suction motor 11 of the cleaner main body 10. The stick 30 includes the first connection pipe 32, a first connection unit 34, a second connection pipe 36 and the second connection unit 38.

The first connection pipe 32 includes a first end portion inserted in and supported by the dust through hole (see 154 of FIG. 3) of the mounting portion 15, and a second end portion connected to the first connection unit 34. The first connection pipe 32 has a circular hollow. The first connection pipe 32 includes a connection end portion 322 at the second end portion. Further, the connection end portion 322 includes a pair of holding-end-portion accommodating grooves 324 spaced apart from each other in a circumferential direction. The first connection pipe 32 is longitudinally provided with the power cable (not shown) electrically connected to a power terminal (not shown) of the battery 14 of the cleaner main body 10. Further, the first connection pipe 32 is provided with a female connector (not shown) to be connected to the power cable at the second end portion and engaged with a male connector 342 of the first connection unit 34.

The first connection unit 34 has a first side detachably connected to the second end portion of the first connection pipe 32 and has a second side supported on the first end portion of the second connection pipe 36. The first connection unit 34 includes the male connector 342 engaged with the female connector (not shown) of the first connection pipe 32 and protruding from one end portion when the first connection unit 34 accommodates and couples with the first connection pipe 32. Here, the second connection unit 38 and the second connection pipe 36 may be formed as a single body, or may be separately manufactured and then coupled. The first connection unit 34 may be supported on the second end portion of the first connection pipe 32 and detachably connect with the first end portion of the second connection pipe 36. The detailed structure of the first connection unit 34 will be described later.

The second connection pipe 36 includes the first end portion connected to the second end portion of the first connection unit 34, and the second end portion detachably connected to the second connection unit 38. The second connection pipe 36 may include a plurality of telescopic second connection tubes 36-1 and 36-2 and be made longer or shorter. The second connection pipe 36 includes a stopper 365 for identifying a position when the plurality of second connection tubes 36-1 and 36-2 is made longer or shorter. The second connection pipe 36 is provided with a power cable 368 arranged in a lengthwise direction. The second connection pipe 36 has a connection end portion 362 at the second end. The connection end portion 362 includes a pair of holding-end-portion accommodating grooves 364 spaced apart from each other in a circumferential direction. Further, the second connection pipe 36 includes a female connector at the second end portion so as to be engaged with a male connector 382 of the second connection unit 38.

The second connection unit 38 may have a first side detachably connected to the second end portion of the second connection pipe 36, and a second side supported on the suction unit 20. The second connection unit 38 includes the male connector 382 engaged with the female connector of the second connection pipe 36 and protruding from the first end portion when the second connection unit 38 accommodates and couples with the second connection pipe 36.

Optionally, the second connection unit 38 may has the first side supported on the second end portion of the second connection pipe 36. In this case, a third connection pipe (not shown) may be supported on the suction unit 20, and has a first end portion to be detachably connected to a second side of second connection unit 38.

According to an alternative embodiment, the stick 30 may exclude the second connection unit 38. Therefore, the first connection unit 34 may have a first side detachably connected to the second end portion of the first connection pipe 32, and a second side supported on the first end portion of the second connection pipe 36. In this case, the second end portion of the second connection pipe 36 is supported on the suction unit 20 because the second connection unit 38 is not present.

According to another alternative embodiment, the stick 30 may exclude the first connection unit 34 and the first connection pipe 32. Therefore, the second connection unit 38 may have the first side supported on the suction unit 20 and the second side detachably connected to the second end portion of the second connection pipe 36. In this case, the second end portion of the second connection pipe 36 is supported on the cleaner main body 10 because the first connection unit 34 and the first connection pipe 32.

Below, the first connection unit 34 according to an embodiment of the disclosure will be described in detail with reference to FIGS. 8 to 10.

Figure 8:
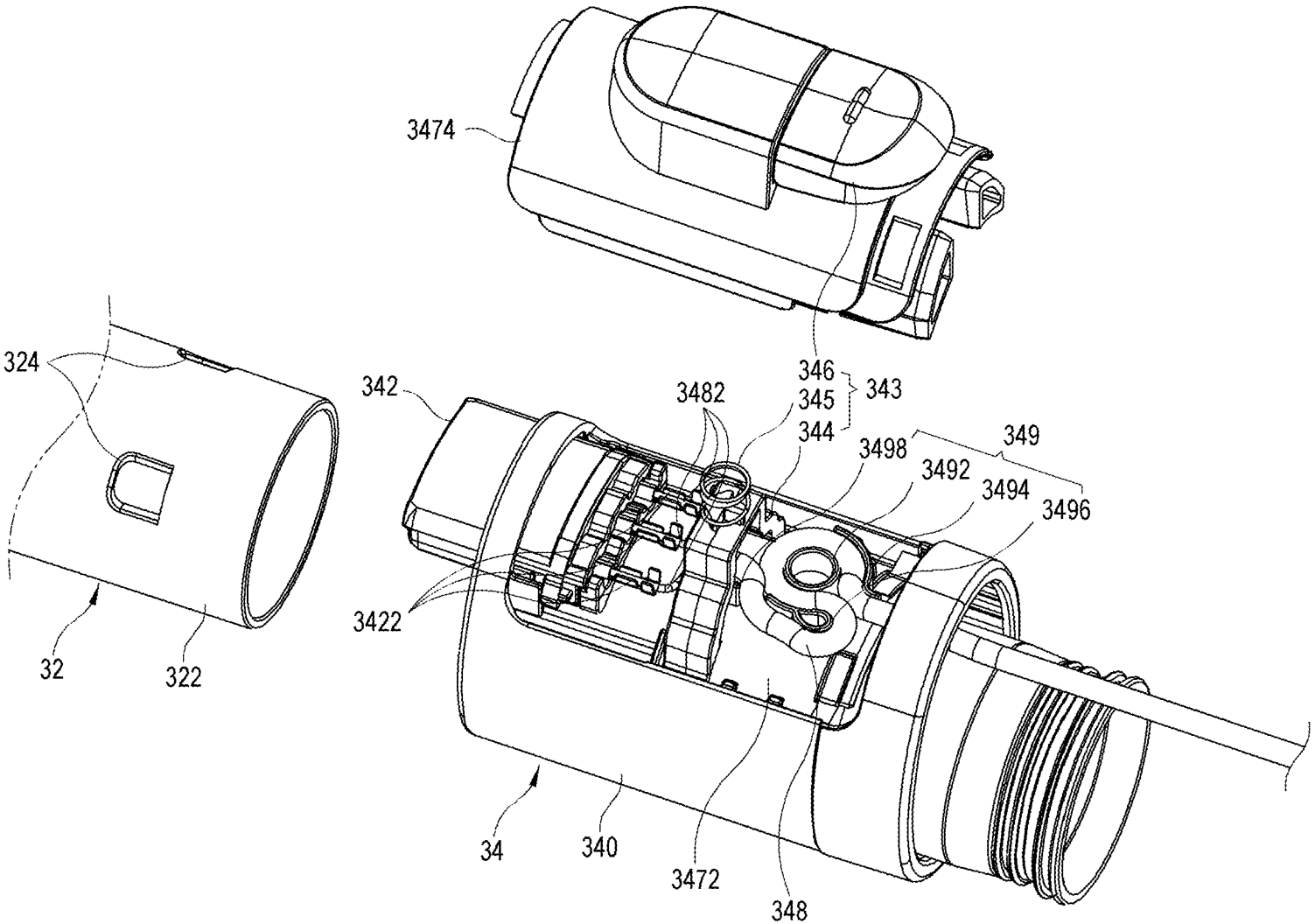
FIG. 8 is a perspective view showing an inside of a connection unit according to an embodiment of the disclosure.
Figure 9:
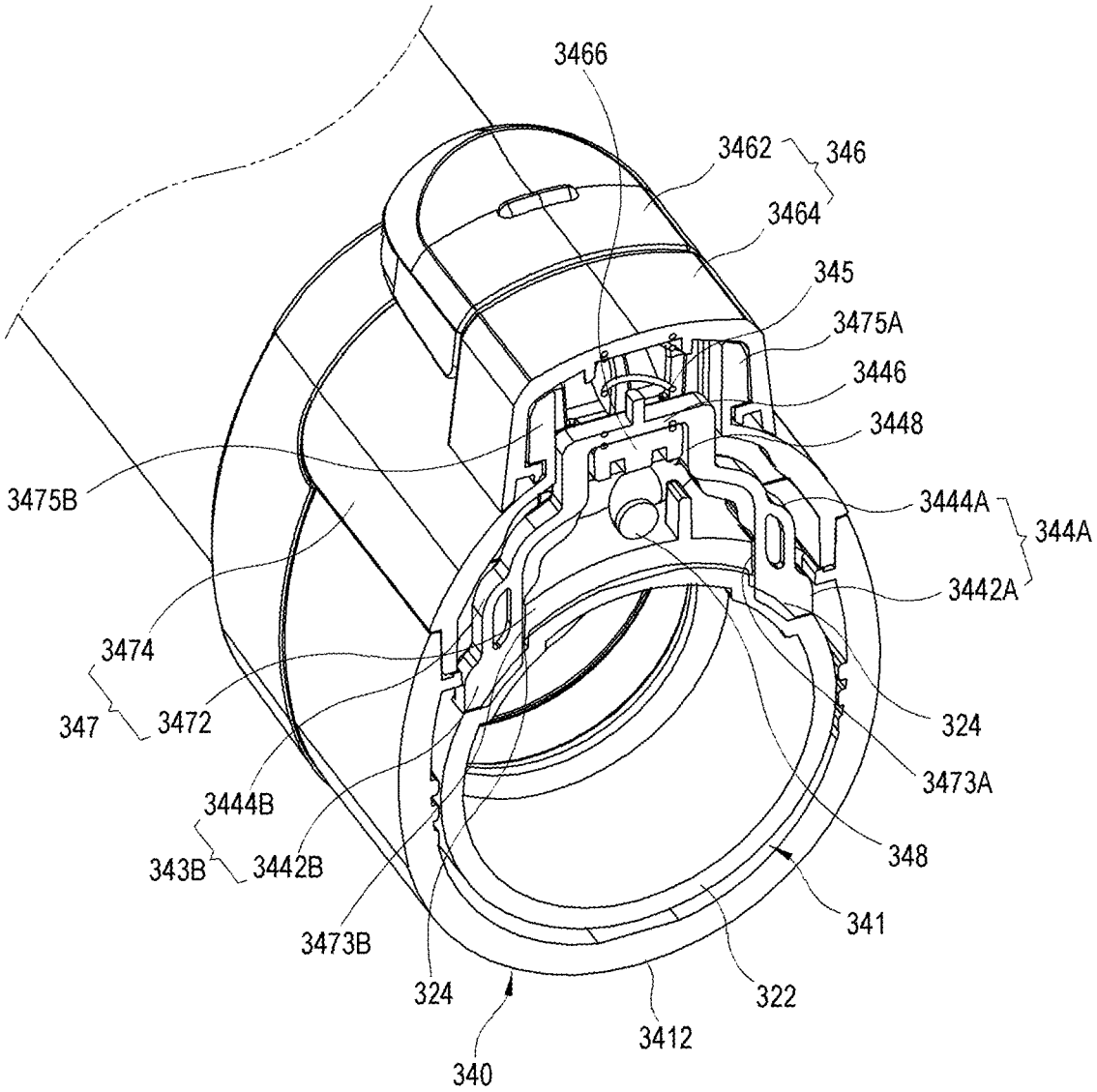
FIG. 9 is a perspective view showing a cross-section cut along line D-D in FIG. 1.
Figure 10:
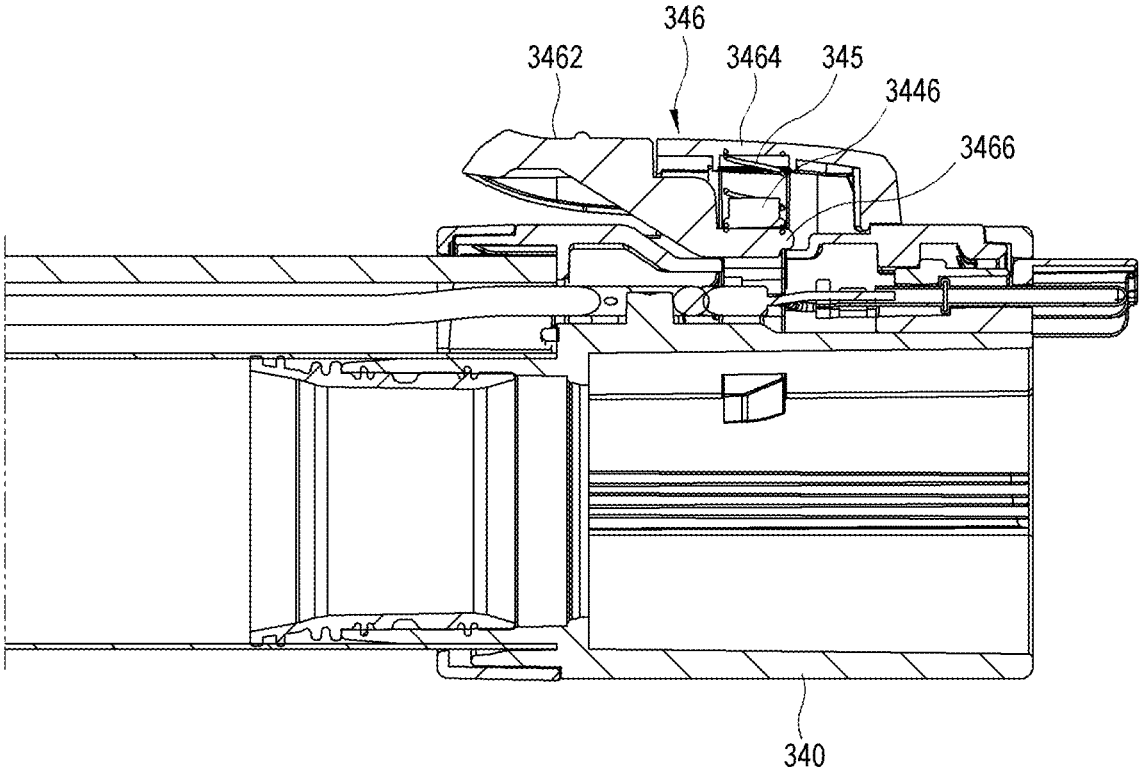
FIG. 10 is an enlarged cross-section view of a connection unit in FIG. 7.
Figure 11:
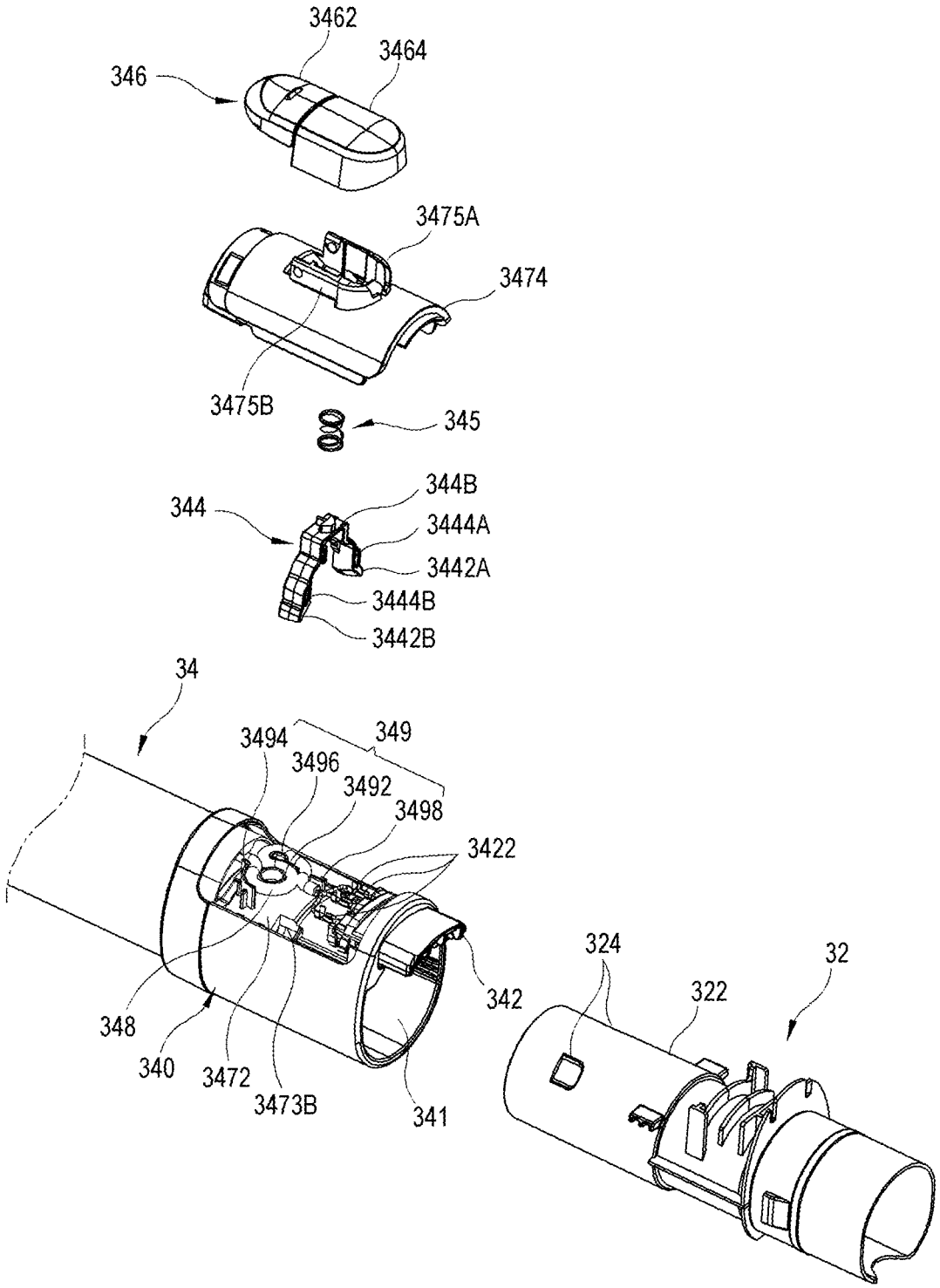
FIG. 11 is an exploded perspective view of a connection unit according to an embodiment of the disclosure.

FIG. 8 is a perspective view of the first connection unit 34 according to an embodiment of the disclosure, FIG. 9 is a perspective view showing a cross-section cut along line D-D in FIG. 1, FIG. 10 is an enlarged cross-section view of the first connection unit 34 in FIG. 7, and FIG. 11 is an exploded perspective view of the first connection unit 34 according to an embodiment of the disclosure.

The first connection unit 34 includes a connection unit main body 340, a connection pipe accommodator 341 accommodating the second end portion 322 of the first connection pipe 32, the male connector 342 engaged with the female connector (not shown) of the first connection pipe 32, a separation controller 343 for separating the inserted second end portion 322 of the first connection pipe 32 from the connection pipe accommodator 341, a space 347 provided in the separation controller 343, a power cable 348 arranged to pass through the space 347, and a cable holder 349 holding the power cable 348.

The connection unit main body 340 has an oval cross-section, of which a major radial portion is formed with the space 347 at a first side and the connection pipe accommodator 341 at a second side. The connection unit main body 340 includes an inner wall 3472 between the space 347 and the connection pipe accommodator 341.

The connection pipe accommodator 341 has a circular cross-section to accommodate the circular second end portion 322 of the first connection pipe 32. The connection pipe accommodator 341 includes an inner wall 3472 having a major radial curvature, and a second outer wall 3412 forming the opposite side of the major radial portion.

The male connector 342 includes three connection terminals 3422 respectively connecting with three wires 3482 of the power cable 348 (a positive wire, a negative wire, a ground wire).

The separation controller 343 includes a lever 344, a spring 345 and a button portion 346.

The lever 344 includes a first lever 3444A, a second lever 3444B, and a lever connector 3446 connecting the first lever 3444A and the second lever 3444B. The first lever 3444A and the second lever 3444B are spaced apart from each other in a circumferential direction, thereby securing a passage not only by which the connection pipe is firmly coupled but also through which the power cable passes. The first lever 3444A and the second lever 3444B respectively have a first holding end portion 3442A and a second holding end portion 3442B at their first end portions. The lever connector 3446 connects the second end portions of a first lever 344A and a second lever 344B, and is internally formed with a press end-portion accommodating groove 3448, thereby easily separating the coupled connection pipe. Under control of the separation controller 343, the first holding end portion 3442A and the second holding end portion 3442B are inserted in or separated from the connection pipe accommodator 341 via first and second holding end-portion through holes 3473A and 3473B arranged on the inner wall 3472 and spaced apart from each other in a circumferential direction. The power cable 348 or three wires (e.g. the positive wire, the negative wire and the ground wire) passes in between the first lever 344A and the second lever 344B, thereby easily disposing the power cable in one space. As necessary, the lever 344 may be provided as a single lever. In this case, the power cable 348 or three wires (e.g. the positive wire, the negative wire and the ground wire) are provided to bypass the lever.

The spring 345 is fitted to the outer portion of the lever connector 3446 and provided between the lever 344 and a button supporter 3464. The spring 345 provides elasticity to push the lever 344 toward the connection pipe accommodator 341. Therefore, the spring 345 makes the first holding end portion 3442A and the second holding end portion 3442B protrude toward the inside of the connection pipe accommodator 341.

The button portion 346 includes a press button 3462 at a first end portion, the button supporter 3464 rotatably supporting the button portion 346, and a press end portion 3466 fitted to the press end-portion accommodating groove 3448 of the lever 344 at a second end portion. A press button 3462 is pressed based on the principle of levers. When the press button 3462 is pressed, the press end portion 3466 is lifted up and the lever 344 also moves up, thereby allowing the first holding end portion 3442A and the second holding end portion 3442B to be separated from the inside of the connection pipe accommodator 341. In result, the first holding end portion 3442A and the second holding end portion 3442B are separated from a holding-end-portion accommodating groove 3224 of the second end portion 322 of the first connection pipe 32, and it is thus possible to separate the first connection pipe 32. Then, the press button 3462 pressed for the separation is restored to an original position by the spring 345.

The space 347 is formed by a boundary between the connection pipe accommodator 341 and the space 347, i.e. formed by an outer surface of the inner wall 3472 forming a part of the connection pipe accommodator 341 and an inner surface of a first outer wall 3474 forming the first side of the major radial portion. The space 347 forms a space in which the separation controller 343 and the power cable 348 are placed. The inner wall 3472 includes a pair of press end-portion through holes 3473A and 3473B spaced apart from each other in a circumferential direction. The first outer wall 3474 forming the first side of the major radial portion is detachably coupled to the connection unit main body 340. The first outer wall 3474 includes first and second standing walls 3475A and 3475B protruding outward therefrom and spaced apart to fit the lever connector 3446 thereto. The first and second standing walls 3475A and 3475B support the button supporter 3464.

The power cable 348 supplies power from the cleaner main body 10 to the suction unit 20. The power cable 348 is a part of the power cable 368 of the second connection pipe 36. The power cable 348 accommodates three wires (e.g. the positive wire, the negative wire, and the ground wire). The power cable 348 is disposed to pass through the space 347 in which the separation controller 343 is provided, thereby making a front view beautiful and facilitating arrangement of the dust container or other components on the front. The power cable 348 passes between the first and second levers 3444A and 3444B. As necessary, three wires (e.g. the positive wire, the negative wire, and the ground wire) may pass between the first and second levers 3444A and 3444B.

After the power cable 348 passes between the first and second levers 3444A and 3444B, three wires (e.g. the positive wire, the negative wire, and the ground wire) are exposed within the space 347 and electrically connected to three connection terminals 3422 of the male connector 342.

The cable holder 349 is placed inside the space 347 and holds and supports the power cable 348 entering the space 347. The cable holder 349 holds and supports the power cable 348 as it is wound into an 'S'-shape. The cable holder 349 includes a first column 3492 around which the power cable 348 is wound, at least one first cable-support wall 3494 standing as spaced apart from the first column 3492 and supporting the power cable 348 wound around the first column 3492, a second column 3496 standing as spaced apart from the first column 3492 and making the power cable 348 coming around from the first column 3492 be wound in a reverse direction, and a second cable-support wall 3498 standing as spaced apart from the second column 3496 and supporting the power cable 348 coming around from the second column 3496.

The second connection unit 38 connects the connection end portion 362 of the second connection pipe 36 and the suction channel 23 of the suction unit 20. The second connection unit 38 has the same structure as the foregoing first connection unit 34, and thus repetitive descriptions will be avoided.

As described above, the stick 30 according to an embodiment of the disclosure has a neat shape when it is viewed from the front because the button portions of the connection units 34 and 38, the stopper 365 of the second connection pipe 36, and the power cable 348 and 368 are all placed on the rear of the stick 30. Further, the dust container 13 is placed on the front, where the button portions are not present, and thus its length may increase as necessary.

As described above, the vacuum cleaner of the disclosure includes a plurality of separation buttons and power cables placed on the rear of the stick, thereby aesthetic improvement when it is viewed from the front and facilitating the arrangement of the dust container or other components on the front of the stick.

Although the present disclosure has been described with various embodiments, various changes and modifications may be suggested to one skilled in the art. It is intended that the present disclosure encompass such changes and modifications as fall within the scope of the appended claims.

What is claimed is:

1. A vacuum cleaner comprising:

a cleaner main body configured to generate suction power;

a suction unit configured to suck up dust and foreign substances by the suction power;

a connection pipe configured to transfer the dust and foreign substances;

a connection unit comprising:

a connection pipe accommodator configured to accommodate an end portion of the connection pipe that includes a pair of holding-end portion accommodating grooves spaced apart from each other in a circumferential direction, and a separation controller configured to separate the accommodated end portion of the connection pipe from the connection pipe accommodator, wherein the separation controller comprises a lever, the lever comprising a first lever and a second lever spaced apart in a circumferential direction of the connection pipe accommodator; and a power cable configured to supply electric power from the cleaner main body to the suction unit and disposed to pass through a space, wherein the space is formed between the first lever, the second lever, and the connection pipe accommodator, the first and second levers configured to insert into the pair of holding-end portion accommodating grooves in a first direction toward inside of the connection pipe accommodator and to separate from inside the connection pipe accommodator when the lever moves in a second direction opposite to the first direction.

2. The vacuum cleaner of claim 1, wherein the space is formed between:

an inner wall; and an outer wall of the connection pipe accommodator spaced apart from the inner wall in a radial direction.

3. The vacuum cleaner of claim 2, wherein:

each of the first and second levers comprise a holding end portion configured to protrude toward or separate from an inside of the connection pipe accommodator while passing through the inner wall; and the separation controller comprises:

an elastic body configured to produce elastic force to push each holding end portion toward the inside of the connection pipe accommodator; and a button portion configured to move the lever in a direction opposite to the elastic force to separate each holding end portion from the inside of the connection pipe accommodator.

4. The vacuum cleaner of claim 3, wherein:

the lever comprises a lever connector configured to connect the first lever and the second lever as a single body, and the button portion urges the lever connector in a direction opposite to the elastic force.

5. The vacuum cleaner of claim 1, wherein:

the separation controller comprises a lever comprising a holding end portion configured to protrude toward or separate from an inside of the connection pipe accommodator, and the end portion of the connection pipe accommodated in the connection pipe accommodator comprises a holding-end-portion accommodating groove in which the holding end portion is inserted.

6. The vacuum cleaner of claim 1, wherein:

the power cable comprises a plurality of wires, and the connection unit comprises a connector comprising a plurality of connection terminals electrically connected to the plurality of wires.

7. The vacuum cleaner of claim 6, wherein the plurality of connection terminals are electrically connected to the plurality of wires within the space where the separation controller is placed.

8. The vacuum cleaner of claim 1, wherein the connection pipe comprises:

a first end portion connected to the cleaner main body; and a second end portion connected to the connection unit.

9. The vacuum cleaner of claim 1, wherein the connection pipe comprises:

a first end portion connected to the suction unit; and a second end portion connected to the connection unit.

10. The vacuum cleaner of claim 1, wherein:

the connection pipe comprises:

a first connection pipe comprising a first end portion connected to the cleaner main body, and a second connection pipe provided between the first connection pipe and the suction unit, and the connection unit comprises:

a first connection unit configured to connect a second end portion of the first connection pipe and a first end portion of the second connection pipe; and a second connection unit configured to connect a second end portion of the second connection pipe and the suction unit.

11. The vacuum cleaner of claim 1, wherein the space in which the separation controller is placed comprises a cable holder configured to hold the power cable.

12. The vacuum cleaner of claim 11, wherein the cable holder comprises:

a first column around which a wire is wound;

a first cable-support wall standing as spaced apart from the first column and supporting the wire wound around the first column;

a second column standing as spaced apart from the first column and making the wire coming around from the first column be wound therearound; and a second cable-support wall standing as spaced apart from the second column and supporting the wire coming around from the second column.

13. The vacuum cleaner of claim 1, wherein:

the connection unit includes an oval shape; and the separation controller is provided at a first side in a major radial direction of the connection unit.

14. The vacuum cleaner of claim 13, wherein the space in which the separation controller is placed is partitioned by an outer wall of the connection unit in the major radial direction and an inner wall forming a part of the connection pipe accommodator.

15. The vacuum cleaner of claim 14, wherein the connection pipe accommodator is formed by an inner wall of the connection unit in a minor radial direction and an outer wall of the connection unit in the major radial direction.

16. A stick vacuum cleaner comprising:

a cleaner main body comprising a dust container configured to accommodate sucked dust or foreign substances;

a suction unit configured to suck up dust and foreign substances by suction power; and a stick configured to transfer the dust or foreign substances sucked up through the suction unit to the dust container, the stick comprising:

a connection pipe comprising a passage configured to transfer the sucked dust or foreign substances, and a connection unit comprising:

a connection pipe accommodator detachably accommodating an end portion of the connection pipe that includes a pair of holding-end portion accommodating grooves spaced apart from each other in a circumferential direction, a separation controller configured to allow the accommodated end portion of the connection pipe to be separable from the connection pipe accommodator, wherein the separation controller comprises a lever, the lever comprising a first lever and a second lever spaced apart in a circumferential direction of the connection pipe accommodator, the first and second levers configured to insert into the pair of holding-end portion accommodating grooves in a first direction toward inside of the connection pipe accommodator and to separate from inside the connection pipe accommodator when the lever moves in a second direction opposite to the first direction, and a power cable provided along a lengthwise direction of the stick and configured to supply electric power from the cleaner main body to the suction unit, wherein:

the dust container is disposed on a front of the stick along the lengthwise direction and adjacent to the stick, and the separation controller and the power cable are disposed on a back of the stick.

17. The stick vacuum cleaner of claim 16, wherein:

each of the first and second levers comprise a holding end portion configured to protrude toward or separate from an inside of the connection pipe accommodator; and the separation controller comprises:

an elastic body configured to produce elastic force to push each holding end portion toward the inside of the connection pipe accommodator; and a button portion configured to move the lever in a direction opposite to the elastic force to separate each holding end portion from the inside of the connection pipe accommodator.

18. The stick vacuum cleaner of claim 17, wherein the separation controller and the power cable are disposed on an opposite side of the stick than the dust container.

19. The stick vacuum cleaner of claim 16, further comprising a battery disposed on an opposite side of the stick than the dust container.

20. The vacuum cleaner of claim 1, further comprising:

a dust container configured to accommodate sucked dust or foreign substances; and a stick configured to transfer the dust or foreign substances sucked up through the suction unit to the dust container, wherein the dust container is disposed on a front of the stick along a lengthwise direction and adjacent to the stick, and wherein the separation controller and the power cable are disposed on an opposite side of the stick than the dust container.

* * * * *